US007724230B2

(12) United States Patent
Kim et al.

(10) Patent No.: US 7,724,230 B2
(45) Date of Patent: May 25, 2010

(54) DRIVING CIRCUIT OF LIQUID CRYSTAL DISPLAY DEVICE AND METHOD FOR DRIVING THE SAME

(75) Inventors: Sun Young Kim, Gyeonggi-do (KR); Chul Sang Jang, Gyeonggi-do (KR); Jong Hoon Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 1064 days.

(21) Appl. No.: 11/375,035

(22) Filed: Mar. 15, 2006

(65) Prior Publication Data

US 2007/0052651 A1 Mar. 8, 2007

(30) Foreign Application Priority Data

Sep. 6, 2005 (KR) ..... 10-2005-0082685

(51) Int. Cl.
*G09G 3/36* (2006.01)

(52) U.S. Cl. ..... 345/98; 370/366; 370/476; 370/477; 370/529

(58) Field of Classification Search ..... None
See application file for complete search history.

(56) References Cited

U.S. PATENT DOCUMENTS 4,893,175 A * 1/1990 Fukada ..... 348/472
5,761,246 A * 6/1998 Cao et al. ..... 375/287
6,559,892 B1 * 5/2003 Kikuchi ..... 348/536
6,570,584 B1 * 5/2003 Cok et al. ..... 345/690
6,611,247 B1 8/2003 Chang et al.
2003/0034947 A1 * 2/2003 Tanaka et al. ..... 345/89
2005/0140614 A1 * 6/2005 Baek ..... 345/87

FOREIGN PATENT DOCUMENTS

JP 7-56543 A 3/1995
JP 8-278479 A 10/1996
JP 11-194737 A 7/1999
JP 2001-255841 A 9/2001
JP 2004-53960 A 2/2004

* cited by examiner

*Primary Examiner*—Sumati Lefkowitz
*Assistant Examiner*—Alonso Tapia
(74) *Attorney, Agent, or Firm*—Holland & Knight LLP

(57) ABSTRACT

A driving circuit of a display device includes a timing controller for combining p first digital data signals (p being a positive integer greater than 1) corresponding to colors for displaying images to generate q second digital data signals and for supplying the q second digital data signals to first to $q^{th}$ data transmission lines (q being a positive integer smaller than p), and a plurality of data driver integrated circuits for processing the q second digital data signals from the timing controller to restore the p first digital data signals, converting the p restored digital data signals into analog data signals, and supplying the analog data signals to a display panel.

9 Claims, 6 Drawing Sheets

DRIVING CIRCUIT OF LIQUID CRYSTAL DISPLAY DEVICE AND METHOD FOR DRIVING THE SAME

The present invention claims the benefit of Korean Patent Application No. P2005-0082685 filed in Korea on Sep. 6, 2005, which is hereby incorporated by reference.

BACKGROUND OF THE INVENTION

1. Field of the Invention

The present invention relates to a display device, and more particularly, to a driving circuit of a liquid crystal display (LCD) device and a method for driving the same, in which the number of data transmission lines and size of frequency are optimized.

2. Discussion of the Related Art

Recently, various flat panel displays having lighter weight and smaller volume than a cathode ray tube have been developed. Examples of the flat panel displays include a liquid crystal display (LCD) device, a field emission display (FED) device, a plasma display panel (PDP) device, and a light emitting display (LED) device.

In general, an LCD device includes a thin film transistor substrate, a color filter substrate, and a liquid crystal layer therebetween. The thin film transistor substrate includes a plurality of liquid crystal cells arranged in respective regions defined by a plurality of data lines and a plurality of gate lines, and a plurality of thin film transistors serving as switching elements formed in the respective liquid crystal cells. The color filter substrate includes a color filter layer. In particular, an LCD device displays desired images by generating an electric field across the liquid crystal layer in accordance with data signals supplied from the data lines, to thereby control light transmittance of liquid crystal molecules in the liquid crystal layer within the respective liquid crystal cells.

FIG. 1 illustrates an LCD device according to the related art. In FIG. 1, an LCD device includes an LCD panel 110, a timing controller 130, a data driver 140, and a gate driver 150. The LCD panel 110 includes liquid crystal cells defined by n gate lines GL1 . . . GLn and m data lines DL1 . . . DLm. The data driver 140 supplies analog data signals to the data lines DL1 . . . DLm, and the gate driver 150 supplies scan pulses to the gate lines GL1 . . . GLn. The timing controller 130 aligns externally inputted digital data signals RGB to be suitable for driving of the LCD panel 110, supplies the aligned digital data signals Data to the data driver 140, and controls the data driver 140 and the gate driver 150.

In the LCD panel 110, each of the liquid crystal cells includes a thin film transistor TFT serving as a switching element. The thin film transistor supplies data signals from the data lines DL1 . . . DLm to the liquid crystal cells in response to the scan pulses from the gate lines GL1 . . . GLn. The liquid crystal cell includes a common electrodes facing a pixel electrode with a liquid crystal material therebetween. The pixel electrode is connected to the thin film transistor TFT. Therefore, the liquid crystal cell is equivalent to a liquid crystal capacitor Clc. The liquid crystal cell also includes a storage capacitor Cst connected to a previous gate line to maintain the data signals in the liquid crystal capacitor Clc until the next data signals are applied thereto.

The timing controller 130 aligns the externally inputted digital data signals RGB to be suitable for driving of the LCD panel 110 and supplies the aligned digital data signals to the data driver 140. Also, the timing controller 130 generates data control signals DCS and gate control signals GCS using a main clock DCLK, a data enable signal DE, and horizontal and vertical synchronizing signals Hsync and Vsync, which are externally inputted, to control driving of the data driver 140 and the gate driver 150.

Although not shown, the gate driver 150 includes a shift register that sequentially generates scan pulses, i.e., gate high pulses in response to the gate control signals GCS from the timing controller 130. In addition, the gate driver 150 includes a plurality of gate driver integrated circuits having the shift register.

FIG. 2 illustrates a connection structure between the timing controller and the data driver shown in FIG. 1. As shown in FIG. 2, the data driver 140 includes a plurality of data driver integrated circuits 242. Each of the data driver integrated circuits 242 receives the digital data signals Data supplied from the data transmission lines 222 and the data control signals DCS supplied from the control signal transmission lines 224. Each of the data driver integrated circuits 242 converts the digital data signals Data aligned from the timing controller 130 into the analog data signals in accordance with the data control signals DCS. Subsequently, the data driver integrated circuits 242 supply the analog data signals to the respective data lines DL1 . . . DLm of the LCD panel 110 (shown in FIG. 1) corresponding to one horizontal line per one horizontal period in which the scan pulses are supplied into the gate lines GL1 . . . GLn. In particular, each of the data driver integrated circuits 242 generates a plurality of gamma voltages having different voltage values corresponding to the number of gray levels of the data signals and selects one gamma voltage as the analog data signal depending on the gray level values of the digital data signals to supply the selected signal to the data lines DL1 . . . DLm.

In addition, the timing controller 130 converts the external digital source data RGB into transistor-transistor logic/complementary metal oxide semiconductor (TTL/CMOS) level depending on a CMOS interface mode and transmits the converted data signals Data to the data driver 140 in one port-to-one port mode or one port-to-two port mode. The timing controller 130 supplies the data signals Data of the TTL/CMOS level to the data transmission lines 222 and at the same time supplies the data control signals DCS to the control signal transmission lines 224.

Each of the data driver integrated circuits 242 is connected to the data transmission lines 222 and the control signal transmission lines 224 in common. Thus, the respective data driver integrated circuits 242 are sequentially driven depending on the data control signals DCS supplied from the control signal transmission lines 224 to receive the data signals from the data transmission lines 222 and convert the received data signals into the analog data signals to supply the converted signals to the respective data lines DL1 to DLm.

However, the aforementioned LCD device according to the related art has several problems. For example, the number of the data transmission lines between the timing controller and the data driver is not optimized, which causes the frequency or the size of the LCD increases greatly. In particular, as the size of the LCD device decreases, the number of the data transmission lines decreases but the frequency of the digital data signals supplied along the data transmission lines increases. On the other hand, as the size of the LCD increases, the number of the data transmission lines increases but the frequency of the digital data signals supplied along the data transmission lines decreases. Therefore, in the LCD device according to the related art, the number of the data transmission lines is not optimized, and its LCD size and the frequency are not balanced.

SUMMARY OF THE INVENTION

Accordingly, the present invention is directed to a driving circuit of a liquid crystal display device and a method for driving the same that substantially obviate one or more problems due to limitations and disadvantages of the related art.

An object of the present invention is to provide a driving circuit of an LCD device and a method for driving the same, in which R/G/B digital data signals are combined with one another to generate fewer digital data signals and the generated digital data signals are supplied to data driver integrated circuits through data transmission lines, to thereby greatly reduce the number of the data transmission lines in comparison with frequency.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a driving circuit of a display device includes a timing controller for combining p first digital data signals (p being a positive integer greater than 1) corresponding to colors for displaying images to generate q second digital data signals and for supplying the q second digital data signals to first to $q^{th}$ data transmission lines (q being a positive integer smaller than p), and a plurality of data driver integrated circuits for processing the q second digital data signals from the timing controller to restore the p first digital data signals, converting the p restored digital data signals into analog data signals, and supplying the analog data signals to a display panel.

In another aspect of the present invention, a driving circuit of a display device includes a timing controller for receiving a plurality of first digital data signals, for generating a plurality of second digital data signals and for supplying the second digital data signals to a plurality of data transmission lines, the first digital data signals corresponding to color information, the number of the first digital data signals being greater than the number of the second digital data signals, and the number of the data transmission lines being the same as the number of second digital data signals, and a data driver integrated circuit for receiving the second digital data signals, for generating a plurality of third digital data signals, for converting the third digital data signals to analog data signals, and for supplying the analog data signals to a display panel, the number of the third digital data signals being the same as the number of the first digital data signals, and the third digital data signals substantially corresponding to the first digital data signals.

In yet another aspect of the present invention, a method for driving a display device includes combining p first digital data signals (p being a positive integer greater than 1) corresponding to colors for displaying images to generate q second digital data signals (q being a positive integer smaller than p), transmitting the q second digital data signals to a data driver integrated circuit signals via first to $q^{th}$ data transmission lines, processing the q second digital data signals to restore the p first digital data signals, converting the p restored digital data signals into analog data signals, and supplying the analog data signals to a display panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to preferred embodiments of the present invention, examples of which are illustrated in the accompanying drawings.

Figure 1:
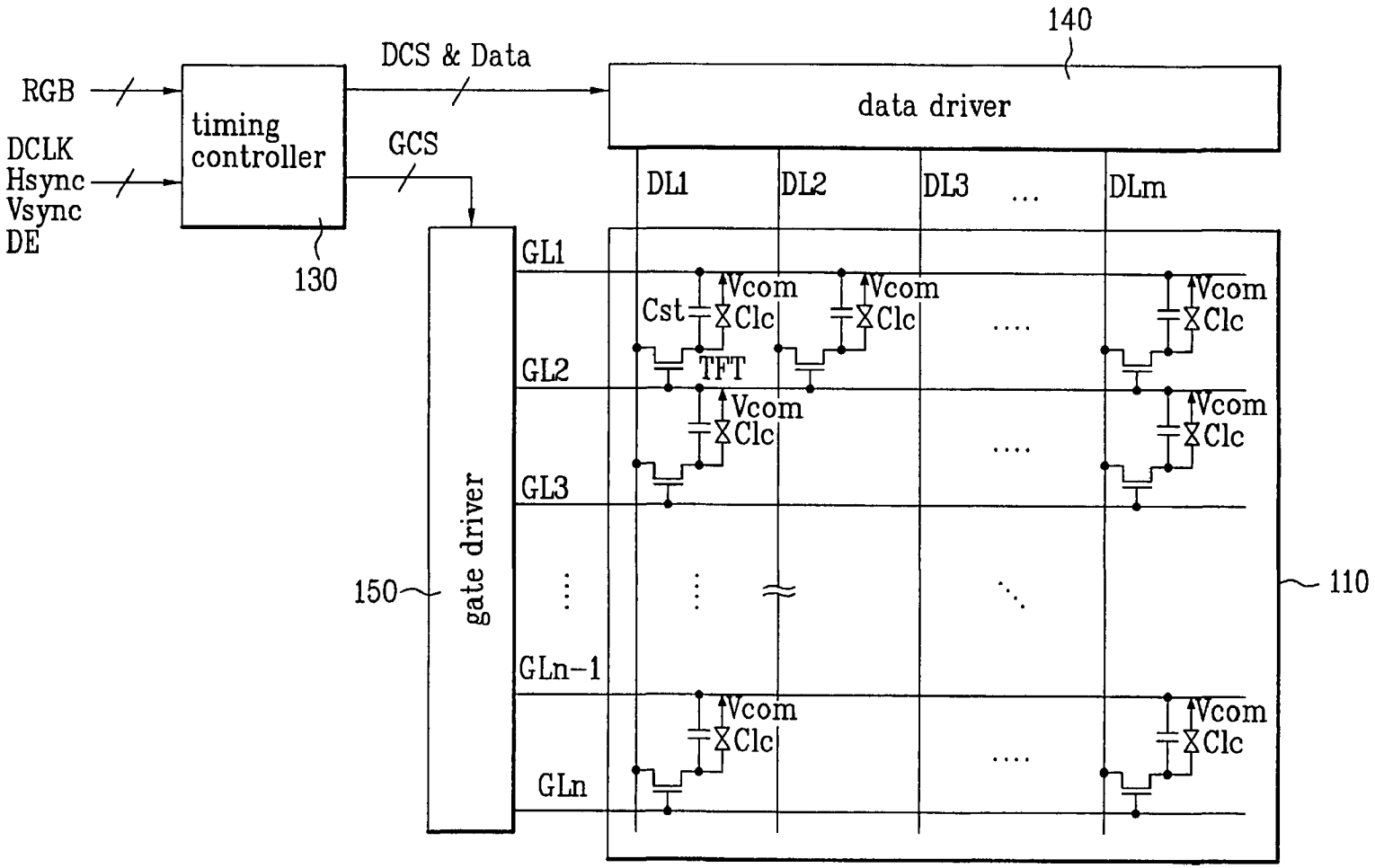
FIG. 1 Related Art
FIG. 1 illustrates an LCD device according to the related art.
Figure 2:
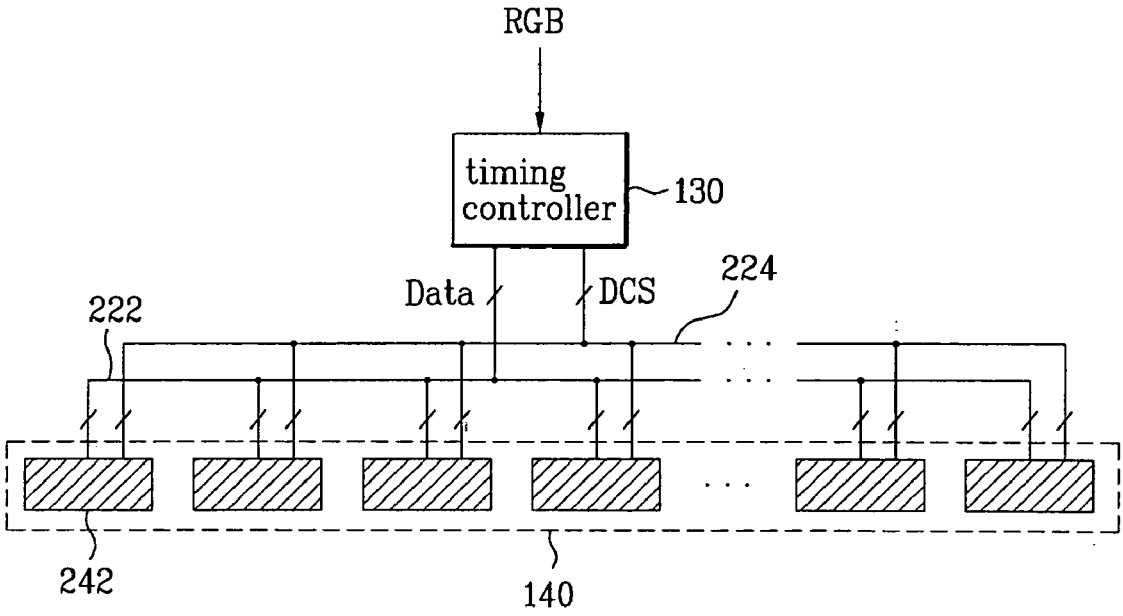
FIG. 2 Related Art
FIG. 2 illustrates a connection structure between the timing controller and the data driver shown in FIG. 1.
Figure 3:
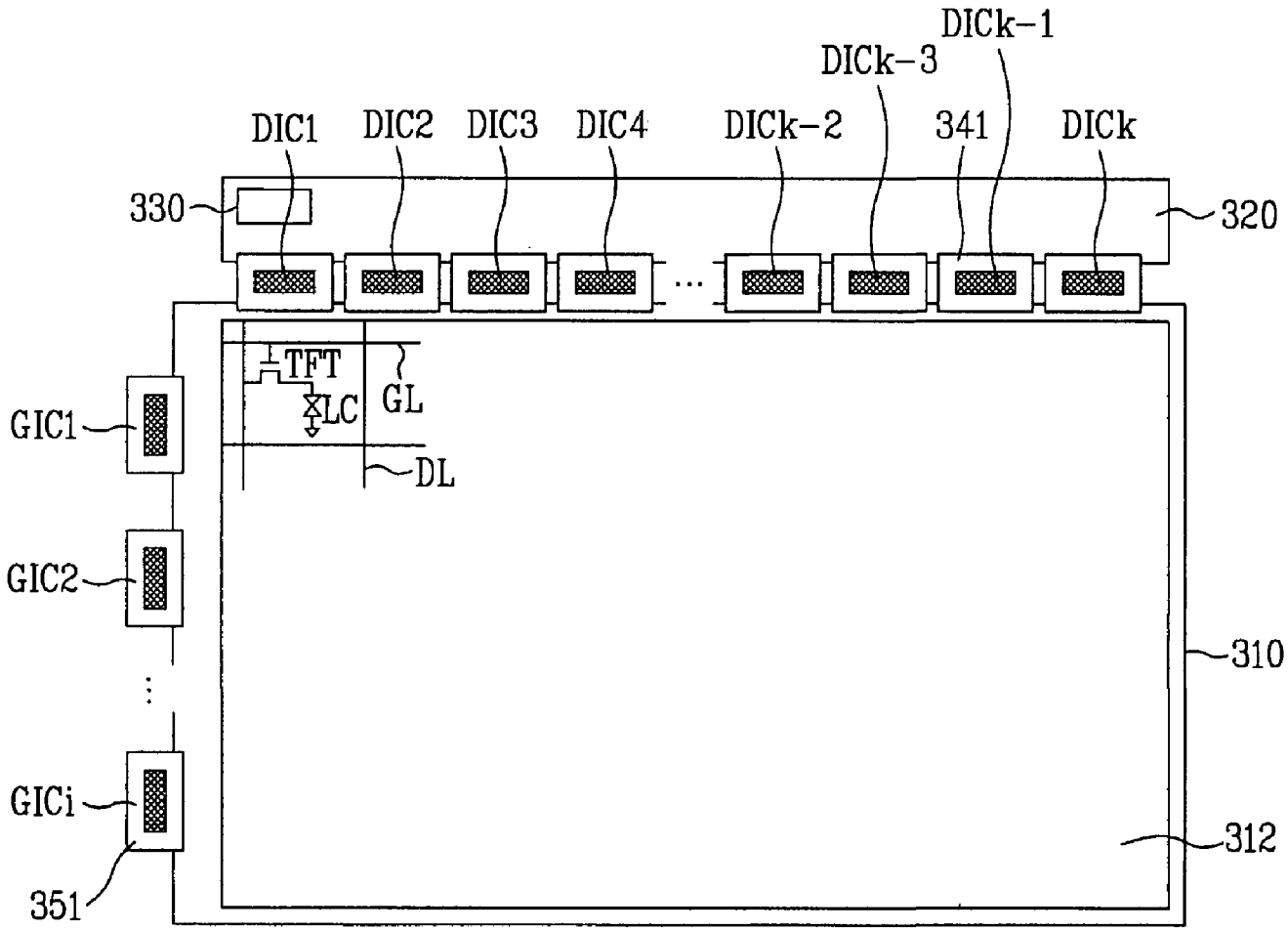
FIG. 3 illustrates an LCD device according to an embodiment of the present invention.

FIG. 3 illustrates an LCD device according to an embodiment of the present invention. In FIG. 3, an LCD device includes an LCD panel 310 including a display unit 312 for displaying images, a plurality of gate driver integrated circuits GIC1 to GICi, a timing controller 330, and a plurality of data driver integrated circuits DIC1 to DICk. In particular, the plurality of gate driver integrated circuits GIC1 to GICi may supply scan pulses to drive the LCD panel 310.

In addition, the timing controller 330 combines original digital data signals corresponding to color information, generates combined digital data signals, and supplies the combined digital data signals to a plurality of data transmission line groups. The original digital data signals corresponding to color information may be supplied from an exterior system (not shown). Further, the plurality of data driver integrated circuits DIC1 to DICk receives the combined digital data signal supplied from the data transmission line groups, restores the combined digital data signals to the original digital data signals, converts the restored original digital data signals into analog signals, and supplies the analog signals to the LCD panel 310.

Further, the LCD device includes a printed circuit board 320, a plurality of data tape carrier packages (TCPs) 341 attached between the printed circuit board 320 and the LCD panel 310, and a plurality of gate TCPs 351 attached to the LCD panel 310. The timing controller 330 and a power circuit may be formed on the printed circuit board 320, and the data driver integrated circuits DIC1 to DICk may be respectively formed on the data TCPs 341.

Each of the data TCPs 341 may be attached between the printed circuit board 320 and the LCD panel 310 by a tape automated bonding (TAB) manner. As a result, input pads of the data TCPs 341 are electrically connected to the printed circuit board 320, and output pads of the data TCPs 341 are electrically connected to data pads of the LCD panel 1310. Also, the gate driver integrated circuits GIC1 to GICi may be respectively formed on the gate TCPs 351. The respective gate TCPs 351 may be electrically connected to gate pads of the LCD panel 310 by a TAB manner.

Moreover, the LCD panel 310 includes k data lines DL and i gate line. To display images, light transmittance of liquid crystal cells LC arranged in a matrix is controlled through the data driver integrated circuits DIC1 to DICk and the gate driver integrated circuits GIC1 to GICi. In particular, each of the liquid crystal cells LC includes a thin film transistor TFT serving as a switching element at an intersection of one of the gate lines GL and one of the data lines DL. The data lines DL are supplied with the analog data signals from the respective data driver integrated circuits DIC1 to DICk.

The printed circuit board 320 may include a reference gamma voltage generator (not shown) for supplying reference gamma voltages GMA to the timing controller 330, the power circuit (not shown) and the respective data driver integrated circuits DIC1 to DICk. Also, the printed circuit board 320 includes signal lines (not shown) for providing electrical connections between respective elements. The signal lines include the data transmission line groups.

The timing controller 330 generates data control signals (DCS) and gate control signals (GCS) using a main clock signal (DCLK), a data enable signal (DE), and horizontal and vertical synchronizing signals (Hsync) and (Vsync), which may be inputted through a user connector (not shown), to control driving timing of the data driver integrated circuits DIC1 to DICk and the gate driver integrated circuits GIC1 to GICi.

The connection structure between the timing controller 330 and the data driver integrated circuits DIC1 to DICk will be described in more details.

Figure 4:
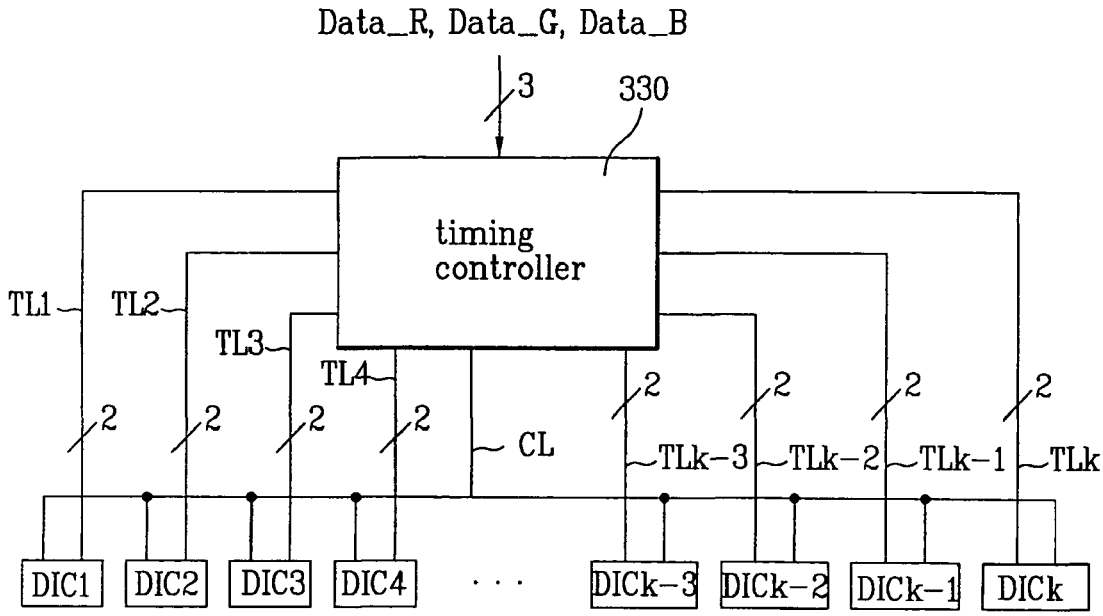
FIG. 4 illustrates a connection structure between the timing controller and the data driver integrated circuits shown in FIG. 3.
Figure 5:
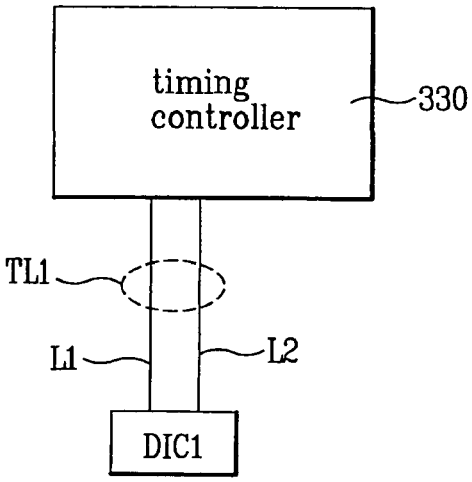
FIG. 5 is a detailed view illustrating the connection structure between the timing controller and a first data driver integrated circuit shown in FIG. 4.

FIG. 4 illustrates a connection structure between the timing controller and the data driver integrated circuits shown in FIG. 3, and FIG. 5 is a detailed view illustrating the connection structure between the timing controller and a first data driver integrated circuit shown in FIG. 4. As shown in FIG. 4, the timing controller 330 and the first to kth data driver integrated circuits DIC1 to DICk are connected with one another by the first to kth data transmission line groups TL1 to TLk. Each of the data transmission line groups TL1 to TLk includes two data transmission lines. As shown in FIG. 5, for example, the first data transmission line group TL1 includes a first data transmission line L1 and a second data transmission line L2. In particular, digital data signals from the timing controller 330 are supplied through the first and second data transmission lines L1 and L2 to the first data driver integrated circuit DIC1.

In addition, one clock signal from the timing controller 330 is supplied respectively to the data driver integrated circuits DIC1 to DICk. In particular, a clock line CL is connected between the timing controller 330 to each of the data driver integrated circuits DIC1 to DICk for respectively transmitting the same clock signal to the data driver integrated circuits DIC1 to DICk.

The timing controller 330 receives more than one digital data signals, e.g., first to $p^{th}$ digital data signals (p being a positive integer greater than 1), supplied from the system (not shown). The first to $p^{th}$ digital data signals have different kinds of color information. For example, when three digital data signals are supplied to the timing controller 330, one digital data signal may correspond to a red data digital signal having red color information, another digital data signal may correspond to a green digital data signal having green color information, and the other digital data signal may correspond to a blue digital data signal having blue color information. Alternatively, when four digital data signals are supplied to the timing controller 330, a white digital data signal having white color information may be additionally provided in addition to the red, green and blue color digital data signals.

Although not shown, the timing controller 330 may be connected to the system through transmission lines. For example, the timing controller 330 and the system may be connected through three transmission lines for respectively transmitting three color digital data signals. If each of the red, green, and blue color digital data signals are 8-bit digital data signals, all bits of the red digital data signal are sequentially supplied to the timing controller 330 through one of the transmission lines, all bits of the green digital data signal are sequentially supplied to the timing controller 330 through another one of the transmission lines, and all bits of the blue digital data signal are sequentially supplied to the timing controller 330 through the other one of the transmission lines.

Furthermore, the timing controller 330 converts the three color digital data signals into first to $q^{th}$ combined digital data signals (q being an integer smaller than p). For example, the timing controller 330 is supplied with the three color digital data signals and then generates two combined color digital data signals.

Alternatively, although not shown, when four digital data signals, e.g., red, green, blue and white color digital data signals, are supplied to the timing controller 330, the timing controller 330 may combine the red, green, blue and white color digital data signals in a similar manner as combining the red, green and blue color digital data signals. For example, the timing controller 330 may combine the red, green, blue and white color digital data signals into three combined data signals, into two combined data signals or into one combined data signal. As such, the timing controller 330 may transmit to a respective one of the data driver integrated circuits DIC1 . . . DICk the three combined data signals through three transmission lines, the two combined data signals through two transmission lines, or the one combined data signal through one transmission line, depending on how the red, green, blue and white color digital data signals are combined.

Figure 6:
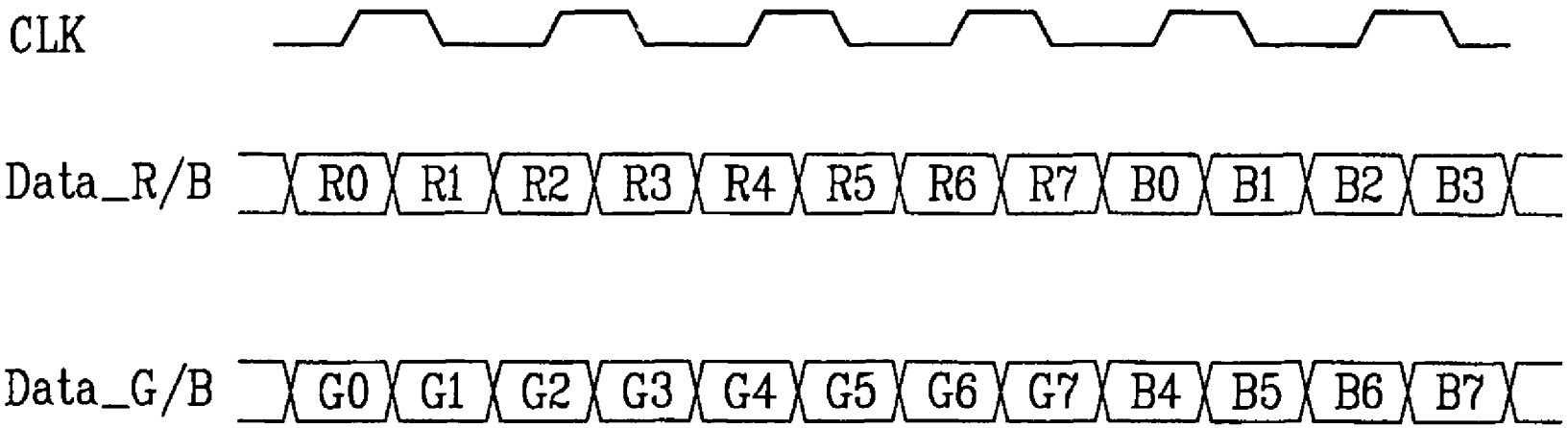
FIG. 6 illustrates waveforms of digital data signals and a clock signal outputted from a timing controller according to an embodiment of the present invention.

FIG. 6 illustrates waveforms of digital data signals and a clock signal outputted from a timing controller according to an embodiment of the present invention. In an embodiment of the present invention, the timing controller 330 (shown in FIG. 4) receives red, blue and green color digital data signals, each of which having 8 bits. As shown in FIG. 6, bits R0 to R7 of the red digital data signal Data_R with higher bits B0 to B3 of the blue digital data signal Data_B may be combined by the timing controller 330 (shown in FIG. 4) to generate a first combined new digital data signal Data_R/B. In addition, bits G0 to G7 of the green digital data signal Data_G with lower bits B4 to B7 of the blue digital data signal Data_B may be combined by the timing controller 330 (shown in FIG. 4) to generate a second combined digital data signal Data_G/B. As a result, two 12-bit combined digital data signals are generated by combining three 8-bit digital data signals.

The clock signal CLK may have a frequency, such that the respective bits of the first and second combined digital data signals Data_R/B and Data_G/B are sampled per up-edge and down-edge of the clock signal CLK and then supplied to the data driver integrated circuits DIC1 to DICk.

The timing controller 330 supplies the first combined digital data signal Data_R/B to the respective one of the data driver integrated circuits DIC1 to DICk. For example, the timing controller 330 may supply the first combined digital data signal Data_R/B to the respective one of data driver integrated circuits DIC1 to DICk through the first data transmission line L1 of the respective data transmission line groups TL1 to TLk. Also, the timing controller 330 may supply the second combined digital data signal Data_G/B to the respective one of data driver integrated circuits DIC1 to DICk through the second data transmission line L2 of the respective data transmission line groups TL1 to TLk. Thus, all data signals for each data driver integrated circuits DIC1 to DICk are transmitted through the same data transmission line group.

Figure 7:
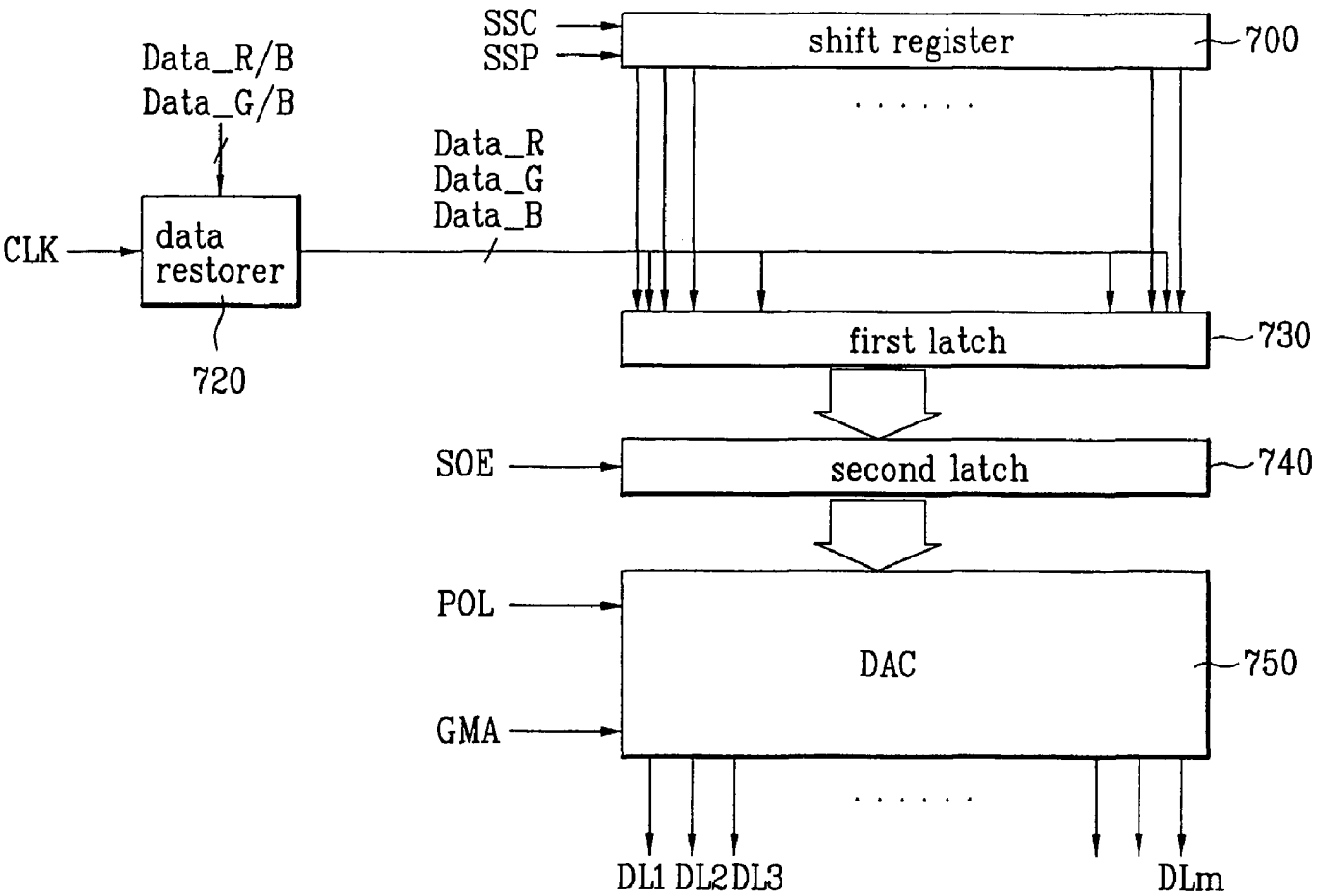
FIG. 7 is a detailed view illustrating a data driver integrated circuit according to an embodiment of the present invention.

FIG. 7 is a detailed view illustrating a data driver integrated circuit according to an embodiment of the present invention. In FIG. 7, a data driver integrated circuit includes a shift register 700, a data restorer 720, a first latch 730, a second latch 740, and a digital-to-analog converter (DAC) 750. When the data driver integrated circuit is connected to the timing controller 330 (shown in FIG. 4), the data restorer 720 may receive the first and second combined digital data signals Data_R/B and Data_G/B supplied from the timing controller 330 (shown in FIG. 4) via a data transmission line group. The data restorer 720 then generates a plurality of restored red, green, and blue digital data signals Data_R, Data_G and Data_B, which preferably are the same as the color digital data signals originally received by the timing controller 330 from the system (not shown). For example, noises may affect the quality of the restored red, green, and blue digital data signals, but the data restorer 720 is designed to duplicate the color digital data signals originally supplied from the system (not shown).

The shift register 700 generates sampling signals using a source shift clock SSC and a source start pulse SSP among the data control signals DCS from the timing controller 330. The first latch 730 then sequentially samples the restored red, green and blue digital data signals Data_R, Data_G, and Data_B from the data restorer 720 in accordance with the sampling signals. Subsequently, the second latch 740 simultaneously outputs the red, green and blue digital data signals Data_R, Data_G, and Data_B sampled by the first latch 730 in accordance with a source output enable (SOE) signal among the data control signals DCS. Further, the digital-to-analog converter 750 converts the digital data signals supplied from the second latch 740 into analog data signals and supplies the converted analog signals to the respective data lines DL1 to DLm of the LCD panel 310 (shown in FIG. 3). In particular, a polarity inversion control signal POL and a reference gamma voltages GMA may be supplied from the timing controller 330 (shown in FIG. 4) to the digital-to-analog converter 750, and the digital-to-analog converter 750 may convert the digital data signals based on these control signals.

According to an embodiment of the present invention, p is set as 3, q is set as 2, k is set as 8, and the data transmission line-group is set to have q data transmission lines. For example, the timing controller receives from a system three original digital date signals, e.g., the red digital data signal Data_R, the green digital data signal Data_G, and the blue digital data signal Data_B, generates two combined digital data signals Data_R/B and Data_G/B, and transmits the combined digital data signals Data_R/B and Data_G/B to eight data driver integrated circuits. Then, the eight data driver integrated circuits recombine the bits of the first and second combined digital data signals Data_R/B and Data_G/B to restore the original digital data signals, Data_R, Data_G and Data_B. The eight data driver integrated circuits supply the restored original digital data signals Data_R, Data_G, and Data_B to respective data lines of an LCD panel.

Comparison between the LCD device according to an embodiment of the present invention and the related art LCD device will now be described based on the frequency and the number of the data transmission lines in Table 1.

TABLE 1

| | TTL | Mini-LVDS | PPDS | An Embodiment of the Present Invention |
|---|---|---|---|---|
| Frequency | 62.2 MHz | 124.4 MHz | 147 MHz | 93.3 MHz |
| Data transmission line | 48 | 24 | 32 | 16 |
| Clock line | 1 | 2 | 4 | 1 |

In Table 1, each of the LCD device according to an embodiment of the present invention, a TTL mode LCD device according to the related art, a Mini-Low Voltage Differential Signal (Mini-LVDS) mode LCD device according to the related art, and a Point to Point Differential Signal (PPDS) mode LCD device according to the related art has resolution of 1920*1080 and is supplied with 8-bit digital data signals. In particular, each of the eight data driver integrated circuits DIC1 to DICk includes 720 channels. The TTL mode LCD device and the Mini-LVDS mode LCD device employ a two port-to-two port mode while the PPDS mode LCD device employs a two-pair mode.

As shown in Table 1, under the same conditions, the LCD device according to an embodiment of the present invention operates at a lower frequency and with fewer data transmission lines than the Mini-LVDS mode and the PPDS mode LCD devices, while using only one clock line. As compared to the TTL mode LCD device, the LCD device according to an embodiment of the present invention has the frequency a little higher than that of the TTL mode LCD device. However, the LCD device according to an embodiment of the present invention employs significantly fewer data transmission lines than the TTL mode LCD device.

As described above, the driving circuit and the driving method thereof according to an embodiment of the present invention supplies the digital data signals after converting them, thereby reducing and optimizing the number of the data transmission lines for data signals transmission and the operation frequency. In addition, although not shown, the driving circuit and the driving method thereof according to an embodiment of the present invention may be employed in liquid crystal display devices or other display devices, such as plasma display devices (PDPs) and electro-luminescence devices (ELDs).

It will be apparent to those skilled in the art that various modifications and variations can be made in the driving circuit of a liquid crystal display device and the method for driving the same of the present invention without departing from the spirit or scope of the invention. Thus, it is intended that the present invention covers the modifications and variations of this invention provided they come within the scope of the appended claims and their equivalents.

What is claimed is:

1. A driving circuit of a display device, comprising:

a timing controller for combining red color, green color and blue color digital data signals corresponding to colors for displaying images to generate first and second combined digital data signals and for supplying the first and second combined digital data signals to first and second data transmission lines, respectively; and a plurality of data driver integrated circuits for processing the first and second combined digital data signals from the timing controller to restore the red color, green color and blue color digital data signals, converting the restored red color, green color and blue color digital data signals into analog data signals, and supplying the analog data signals to a display panel;

wherein the first combined digital data signal is generated by combining all bits of the red color signal with first bits of the blue color digital data signal, and the second combined digital data signal is generated by combining all bits of the green color digital data signal with second bits of the blue color digital data signal.

2. The driving circuit according to claim 1, wherein each of the data driver integrated circuits includes:

a data restorer for processing the first and second combined digital data signals supplied through the first and second transmission lines to restore the red color, green color and blue color digital data signals;

a shift register for generating sampling signals using a source shift clock and a source start pulse from the timing controller;

a latch for latching the restored red color, green color and blue color digital data signals from the data restorer in accordance with the sampling signals supplied from the shift register; and a digital-to-analog converter for converting the latched digital data signals from the latch into analog data signals to supply the analog data signals to the display panel.

3. The driving circuit according to claim 1, wherein the first and second data transmission lines are placed between the timing controller and each of the data driver integrated circuits.

4. The driving circuit according to claim 1, further comprising:

a clock signal transmission line for transmitting a clock signal from the timing controller to each of the data driver integrated circuit, each of the data driver integrated circuits samples the first and second combined digital data signals in accordance with the clock signal.

5. A driving circuit of a display device, comprising:

a timing controller for receiving red color, green color and blue color digital data signals, for generating first and second combined digital data signals and for supplying the first and second combined digital data signals to first and second data transmission lines, respectively; and a data driver integrated circuit for receiving the first and second combined digital data signals, restoring the red color, green color and blue color digital signal, for converting the restored red color, green color and blue color digital signals to analog data signals, and for supplying the analog data signals to a display panel;

wherein the first combined digital data signal is generated by combining all bits of the red color signal with first bits of the blue color digital data signal, and the second combined digital data signal is generated by combining all bits of the green color digital data signal with second bits of the blue color digital data signal.

6. The driving circuit according to claim 5, wherein the data driver integrated circuit includes:

a data restorer for processing the first and second combined digital data signals to restore the red color, green color and blue color digital data signals;

a shift register for generating sampling signals using a source shift clock and a source start pulse from the timing controller;

a latch for latching the restored red color, green color and blue color digital data signals in accordance with the sampling signals; and a converter for converting the latched digital data signals into analog data signals to supply the analog data signals to the display panel.

7. The driving circuit according to claim 5, wherein the first combined digital data signal is transmitted from the timing controller to the data integrated circuit via a first data transmission line, and the second combined digital data signal is transmitted from the timing controller to the data integrated circuit via a second data transmission line.

8. A method for driving a display device, comprising:

combining red color, green color and blue color digital data signals corresponding to colors for displaying images to generate first and second combined digital data signals, wherein the first combined digital data signal is generated by combining all bits of the red color signal with first bits of the blue color digital data signal, and the second combined digital data signal is generated by combining all bits of the green color digital data signal with second bits of the blue color digital data signal;

transmitting the first and second combined digital data signals to a data driver integrated circuit via first and second data transmission lines, respectively;

processing the first and second combined digital data signals to restore the red color, green color and blue color digital data signals;

converting the restored red color, green color and blue color digital data signals into analog data signals; and supplying the analog data signals to a display panel.

9. The method according to claim 8, further comprising:

generating sampling signals using a source shift clock and a source start pulse; and latching the restored red color, green color and blue color digital data signals in accordance with the sampling signals.

* * * * *